United States Patent [19]

Van Houwelingen

[11] 4,135,803

[45] Jan. 23, 1979

[54] DEVELOPING APPARATUS FOR HIGH RESOLUTION PHOTO-SENSITIVE DIAZO PLATES

[75] Inventor: Hendrik Van Houwelingen, Ryswyk, Netherlands

[73] Assignee: GAF Corporation, New York, N.Y.

[21] Appl. No.: 782,432

[22] Filed: Mar. 29, 1977

[51] Int. Cl.[2] ..... G03D 7/00

[52] U.S. Cl. ..... 354/299; 354/300; 34/36

[58] Field of Search ..... 354/299, 300; 34/15, 34/16, 36, 79, 80, 92, 140, 155, 218

[56] References Cited

U.S. PATENT DOCUMENTS

| | | | |
|---|---|---|---|
| 2,761,364 | 9/1956 | Cross | 354/300 |
| 3,720,150 | 3/1973 | Hurtig | 354/300 |
| 3,900,862 | 8/1975 | Bennett | 354/300 |
| 3,982,258 | 9/1976 | Czenbiniak | 354/300 |
| 4,048,645 | 9/1977 | Reams | 354/300 |
| 4,062,031 | 12/1977 | Schroter | 354/300 |

*Primary Examiner*—John Gonzales
*Assistant Examiner*—Alan Mathews
*Attorney, Agent, or Firm*—Walter C. Kehm; J. Gary Mohr; Arthur Dresner

[57] ABSTRACT

An apparatus for developing high resolution photosensitive diazo plates by exposure to ammonia vapor is provided. The apparatus comprises a reservoir for aqueous ammonia, heating means for vaporizing said aqueous ammonia to produce humidified ammonia vapor within said reservoir, means for introducing air into said reservoir to mix with the ammonia vapors, a condensation chamber in communication with said reservoir to receive the ammonia vapor-air mixture to condense any liquid ammonia droplets therefrom, a developing chamber having an inlet and outlet and means for holding a plurality of high resolution photo-sensitive plates in the line of flow from the inlet to the outlet, a three-way valve to selectively communicate the condensation chamber and the inlet of the developing chamber to introduce the ammonia developing medium therein, and the exterior of the apparatus and the developing chamber to introduce ambient air therein for flushing said ammonia from the developing chamber, and a vacuum pump in communication with the outlet of the developing chamber to cause the flow of ammonia through the developing chamber in contact with the photo-sensitive plates during the development process, and to cause the flow of ambient air therethrough to evacuate the ammonia from the developing chamber during the flushing process. The ammonia evacuated from the developing chamber during both the development process and the flushing process is carried via the vacuum pump to an absorption vessel to neutralize the same.

14 Claims, 2 Drawing Figures

DEVELOPING APPARATUS FOR HIGH RESOLUTION PHOTO-SENSITIVE DIAZO PLATES

BACKGROUND OF THE INVENTION

The use of non-silver halide high resolution photosensitive plates for the production of microelectronic components has become quite prevalent in recent years. These plates generally comprise a stable transparent substrate, such as glass, and a coating of a thin uniform layer of a volatile, preferably organic, solvent solution of a resin adapted to form an adherent transparent film upon evaporation of the solvent. The coating contains a photo-sensitizing composition comprising an azo coupling component and a light sensitive diazonium compound susceptible of decomposition upon exposure to actinic light. The composition is temporarily stabilized against coupling pending development of the latent image.

After exposure to actinic light through a primary mask bearing the desired pattern of a microelectronic device to be reproduced, the plate is developed by treatment with moist ammonia vapor. To facilitate such treatment, various types of developing apparatuses have been provided in which to properly expose the sensitized plates to wetted ammonia to develop the image thereon. Available developing devices often comprise merely a container or housing formed of plastic material adapted to receive therein a large plurality of exposed diazo plates, and an opening in which moisturized ammonia is introduced from an exterior source. Unfortunately, the use of these simple containers requires additional means remote therefrom for moisturizing ammonia vapor, and condensing ammonia droplets from the wetted ammonia vapor. As a result, prior developing apparatuses of this type require elaborate set-up arrangements to avoid the danger of inadequate seals and connections between the various components and the possibility of ammonia leakage to the surrounding environment.

To overcome these difficulties and provide a useful, efficient developing apparatus for diazo photo-sensitive plates, a substantially unitary developing apparatus has been provided by Czebiniak in U.S. Pat. No. 3,982,258. The apparatus disclosed in such patent is generally formed by a single housing having a humidity conditioning chamber containing concentrated ammonia hydroxide liquid through which ammonia gas from an external source, i.e. bottled anhydrous NH3, may be bubbled to raise its moisturization level, a condensation chamber adjacent the humidity conditioning chamber to remove liquid ammonia droplets, means connecting the humidity conditioning chamber to the condensation chamber, a developing chamber adjacent the condensation chamber for accomodating a plurality of plates to be developed by exposure to the moisturized ammonia, and means connecting the developing chamber with the condensation chamber for supplying moisturized ammonia thereto. A sealable cover or door is provided to gain access to the developing chamber for the insertion and removal of sensitized plates. Conduit means are connected to the developing chamber for supplying pressurized dry air or nitrogen from another external source in order to flush the chamber of residual ammonia after developing.

While the aforementioned Czebiniak developing apparatus has generally been found to be satisfactory, under certain conditions it has been found that the humidity level of the anhydrous ammonia is not raised sufficiently by bubbling through the ammonium hydroxide, resulting in poor quality development. Moreover, the ammonia vapor does not always circulate thoroughly within the developing chamber since such circulation depends entirely upon the pressure imparted to the gas by the external anhydrous ammonia bottle. As the pressure within the bottle is reduced, circulation becomes impaired. In addition, it has been found that such developing apparatus cannot be utilized in many industrialized nations, particularly those in Europe, since the use of bottled anhydrous ammonia is either prohibited or requires costly licenses and insurance.

Other diazo type developing means, particularly for photocopy machines, have previously dealt with the problem of circulating sufficient gaseous ammonia within a developing chamber and subsequently evacuating such ammonia from the chamber upon completion of the development process. Such a device is shown in U.S. Pat. No. 3,900,862 to Bennett, et al. The apparatus disclosed in such patent comprises a developing chamber for receiving exposed diazo-type sensitized paper, means for introducing and circulating gaseous ammonia within the chamber to develop an image on the sensitized paper and a vacuum pump for evacuating the ammonia from the developing chamber. A portion of the ammonia which is evacuated from the developing chamber is recirculated through a reservoir containing ammonium hydroxide, and the balance is discharged into an absorption chamber containing an ammonia absorbing agent, such as citric acid. While the Bennett, et al. developing apparatus is most suitable and quite satisfactory for developing diazo-type sensitized paper for photocopy purposes, it is inadequate for developing high resolution sensitized diazo plates, since it makes no provision for adequately moisturizing the ammonia. Moreover, while the quantity of gas circulated within the developing chamber is sufficient for developing sensitized photocopy paper, it is insufficient to adequately reproduce the image on the high resolution plates referred to above.

SUMMARY OF THE INVENTION

In accordance with the present invention, an improved developing apparatus for high resolution sensitized diazo plates of the type described hereinabove is provided to overcome the problems of insufficient ammonia circulation, of insufficient moisturization, and the need for providing an external pressurized ammonia bottle. In addition, the present invention provides means for evacuating the ammonia from the developing chamber after the developing process has been completed without the need for an external supply of pressurized nitrogen or air to be introducted into such chamber.

The foregoing is accomplished by means of a unitary developing apparatus having therein a reservoir adapted to receive a suitable quantity of liquid ammonium hydroxide. A portion of the reservoir includes a heating device which is adapted to vaporize the ammonia in sufficient quantities to produce wetted gaseous ammonia for developing the high resolution plates. Circulation of the wetted ammonia through the developing chamber is maintained by means of a vacuum pump located downstream of the developing chamber. In this manner, a suitable quantity of ammonia vapor, having a sufficiently high relative humidity is maintained and continually introduced into the developing chamber during the developing process. Upon completion of the developing process, a three-way valve which is located on the exterior of the unitary structure, is manually operative to cut off the flow of ammonia vapor and permits the flow of ambient air into the developing chamber. The vacuum pump then circulates such air through the chamber to fully evacuate remaining ammonia fumes. Upon completion of the evacuation process, the chamber is free from such fumes and may be safely opened for the removal of the developed plates without the danger of contaminating the surrounding area, and without the need for providing extensive means for exhausting such fumes to the exterior of the building area in which the developing apparatus is located.

In general, the developing apparatus of the present invention comprises, in combination, a developing chamber having an inlet for receiving a gaseous ammonia developing medium, an outlet for discharging such developing medium, and means for receiving a plurality of photo-sensitive plates therein in the line of flow from the inlet to the outlet, a reservoir for containing a twenty-five percent liquid ammonium hydroxide solution, a heating chamber in communication with said reservoir having heating means adapted to vaporize said ammonium hydroxide to produce humidified gaseous ammonia, a condensation chamber in communication with said reservoir adapted to receive therefrom wetted ammonia vapor and to condense therefrom any droplets of liquid ammonia, a manual three-way valve adapted to selectively communicate the inlet of the developing chamber with the condensation chamber to introduce ammonia vapor for developing the photo-sensitive plates, and the exterior of the apparatus to introduce ambient air for evacuating the developing chamber, a vacuum pump in communication with the outlet of the developing chamber to cause the flow of ammonia vapor through the developing chamber in contact with the photo-sensitive plates to be developed and to evacuate such ammonia from the developing chamber, and an absorption chamber in communication with the downstream side of said vacuum pump to absorb the ammonia vapor withdrawn from the developing chamber.

The heating means to vaporize the liquid ammonia in the reservoir is preferably a thermostatically controlled electric heater having a 125 watt power output capable of heating the ammonia solution in the heating chamber to approximately 80 degrees centigrade. A further thermostatic control for the heater can also be provided within the reservoir to maintain the temperature of the ammonia vapor located above the liquid ammonium hydroxide at either 45±1 or 50±1 degrees centigrade depending on the ambient temperature. It has been found that in order to prevent condensation in the developing chamber, the vapor temperature within the reservoir must be held to 50±1° C. at 20° C. ambient temperature and 45±1° C. at 24° C. ambient temperature. The heating chamber is arranged so that it receives the liquid ammonia from the lower portion of the reservoir and permits the vaporized ammonia to rise above the liquid within said reservoir. The proper flow of ammonia through the developing chamber is maintained by the vacuum pump which, together with the heater, can be manually or automatically controlled to provide the desired quantity and flow of ammonia. As additional means to control the vapor flow through the developing chamber and maintain the desired concentration of ammonia, the developing chamber can be provided with a pressure relief valve responsive to the below atmospheric pressure within the developing chamber to open when such internal pressure is reduced below a predetermined value, thereby permitting the entry of ambient air to modulate and maintain the internal pressure of the tank at a desired level and to maintain the desired concentration of ammonia within such developing chamber. The valve also serves as a safety means to relieve an excessive negative pressure within the developing chamber in the event that the three-way valve is improperly positioned.

By maintaining a constant flow of moist ammonia vapor through the developing chamber at the desired temperature of either 45±1 or 50±1 degrees centigrade as noted hereinbefore, the developing apparatus of the invention provides a reproducible method for developing photo-sensitive plates at a continuous rate that was not possible heretofore. In this regard, it has been found that the developing time for a plurality of high resolution plates is approximately three minutes, and the venting procedure whereby ambient air is drawn through the developing chamber requires approximately ten minutes. In both instances, the developing and venting times are considerably reduced from that associated with the prior art developing means.

The gaseous ammonia exhausted from the developing chamber by the vacuum pump is neutralized by passing the same through a suitable liquid absorbent material, such as citric acid. For such purpose, an absorption vessel containing the absorbent material is formed as part of the developing apparatus and suitable tubing is provided from the vacuum pump to such vessel so that the ammonia may be bubbled through the absorbent to accomplish complete neutralization. As a further alternative, the outlet of the vacuum pump can be connected to a catalytic converter for the breakdown of the ammonia to its component constituents of nitrogen gas and water vapor.

The foregoing features of the developing apparatus of the invention are further described in reference to the annexed drawings.

DETAILED DESCRIPTION OF THE PREFERRED EMBODIMENT

Figure 1:
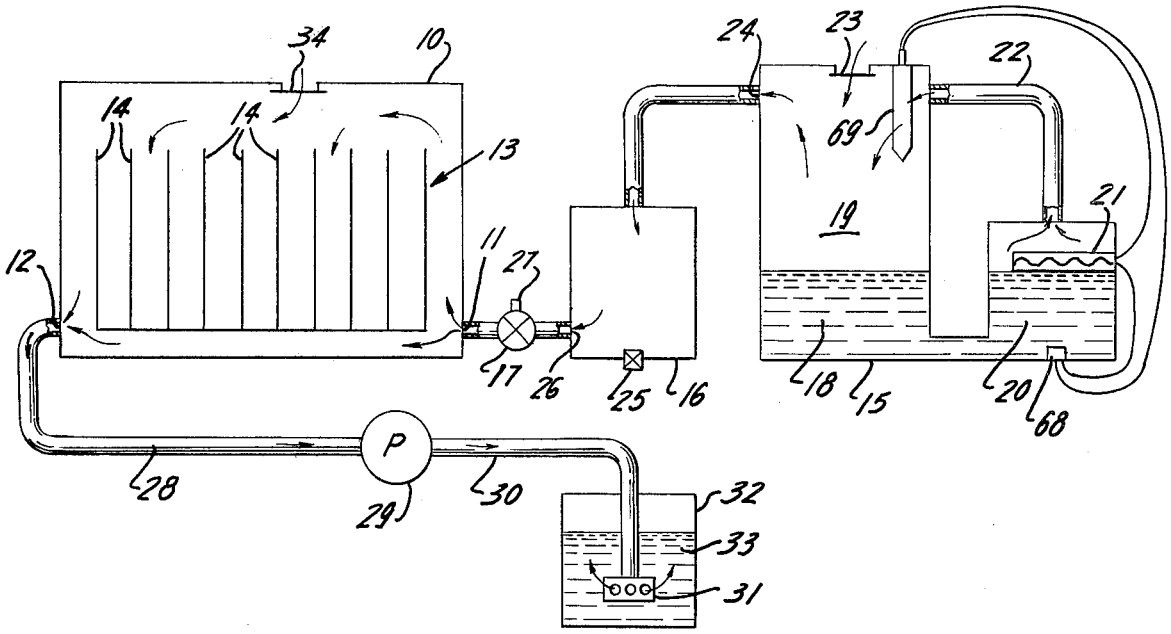
FIG. 1 is a schematic diagram illustrating the various components of the developing apparatus of the invention in relation to the flow of ammonia developing medium.

Referring now to FIG. 1, an apparatus for photo-sensitive high resolution diazo plates by exposure to ammonia vapor in accordance with the present invention is shown schematically. Such developing apparatus comprises a developing chamber 10 having an inlet 11 for receiving either gaseous ammonia or ambient air, an outlet 12 adapted to discharge a mixture of ammonia and air therefrom, and a rack 13 disposed in the line of flow from the inlet 11 to the outlet 12 and adapted to hold a plurality of high resolution photo-sensitive diazo plates 14 to be developed. A reservior 15 for providing ammonia developing medium is disposed upstream of the developing chamber 10 and is connected thereto by means of a condensation chamber 16 and a three-way valve 17. The reservoir 15 contains a solution of twenty-five percent ammonium hydroxide (NH4OH). Gaseous ammonia 19 obtained by vaporizing the NH4OH is disposed in the reservoir above the liquid ammonium hydroxide. The reservoir 15 includes a heating chamber 20 communicating therewith and maintaining therein the same level of ammonium hydroxide 18.

An electric heating element 21 is disposed within the heating chamber 20 in contact with the liquid 18. The heater 21 is preferably capable of a power output of approximately 125 watts and is adapted to continuously heat the ammonium hydroxide solution to a temperature of approximately eighty degrees centigrade, at which temperature the liquid ammonia is vaporized to produce gaseous ammonia having a relatively high moisture content. A thermostat 68 disposed at the bottom of heating chamber 20 operatively controls the heater 21 to maintain the desired temperature of the liquid ammonia to assure continuous vaporization, and to prevent overheating when no liquid is present in the heating chamber. In addition, a further thermostatic means 69 is adapted to control the heater 21 to maintain the temperature of the gaseous ammonia within the reservoir at 45±1° C. when the ambient temperature is 24° C. and at 50±1° C. when the ambient temperature is 20° C. It should be noted that for this purpose an additional heater within the developing chamber can be provided, if necessary.

The ammonia vapor is conducted from the upper portion of heating chamber 20 to the upper portion of the main reservoir 15 via a conduit 22. The upper portion of reservoir 15 also includes a normally closed check valve 23 which permits the entry of ambient air into the reservoir when the internal pressure thereof is reduced below atmospheric. An outlet 24 also disposed in the upper portion of reservoir 15 permits the flow of the vaprous ammonia air mixture from the reservoir to the condensation chamber 16. For illustrative purposes the connection between the reservoir 15 and the condensation chamber 16 is shown schematically in FIG. 1 as a conduit. In the preferred embodiment, which will be described hereinafter with reference to FIG. 2, it will be seen that the reservoir, the condensation chamber and the developing chamber can all be disposed in a single unitary housing and that the use of a conduit between such chambers will be obviated.

It has been found that droplets of ammonia which come in direct contact with sensitized diazo plates may cause damage to the resulting photographic plate and produce a defective product. Hence, it is desirable that all liquified droplets of ammonia be removed from the developing medium prior to the entry of such developing medium into the developing chamber. Accordingly, condensation chamber 16 is provided in the line of flow from the reservoir 15 to the developing chamber 10. It is the purpose of such condensation chamber as its name implies to condense any and all droplets of liquified ammonia which may exist in the vapor introduced thereto from reservoir 15. A suitable petcock 25 is provided at the lower-most portion of condensation chamber 16 to permit the removal therefrom of any liquified ammonia. Means can, of course, be provided to conduct such liquified ammonia from the bottom of condensation chamber 16 back to reservoir 15.

The outlet 26 of condensation chamber 16 is connected to one port of three-way valve 17. Another port of valve 17 is connected to inlet 11 of the developing chamber 10, and the third port of valve 17 is open to ambient air. Valve 17 is manually movable between a first position in which the outlet 26 of condensation chamber 16 is connected to the inlet 11 of developing chamber 10 to permit the flow of ammonia from the reservoir to the developing chamber, and a second position in which port 27, open to ambient air, is connected to inlet 11 of the developing chamber 10 to permit the flow of such ambient air into said chamber for the purposes of flushing residual ammonia vapor therefrom after the completion of the development process. It should be noted that in the second position of valve 17 the outlet 26 of condensation chamber 16 is closed. In this regard, it should also be noted that when valve 17 is in said second position, the ammonia contained within reservoir 15 and condensation chamber 16 cannot leak to the exterior of the developing apparatus. Under such circumstances, the pressure within reservoir 15 will generally be greater than or equal to the pressure of the ambient air thus maintaining valve 23 in its closed position to prevent the accidental discharge of ammonia vapor.

The outlet 12 of developing chamber 10 is connected by means of a conduit 28 to the suction side of piston type vacuum pump 29 operatively driven by means of a suitable electric drive motor. The outlet or pressure side of vacuum pump 29 is connected via a conduit 30 to a perforated gas distributor 31 which is disposed within an absorption vessel 32 below the surface of a citric acid solution 33 in such vessel for the purpose of absorbing ammonia gas discharged by pump 29. This further prevents the leakage and discharge of gaseous ammonia in the area surrounding the developing apparatus of the invention.

To avoid underpressurization of the developing chamber 10 in the event of a malfunction of either valve 17 or valve 23, a further check valve 34 is disposed at the top of developing chamber 10. The reduction of the pressure within chamber 10 below a predetermined value will cause valve 34 to open and permit the entry therein of atmospheric air.

Figure 2:
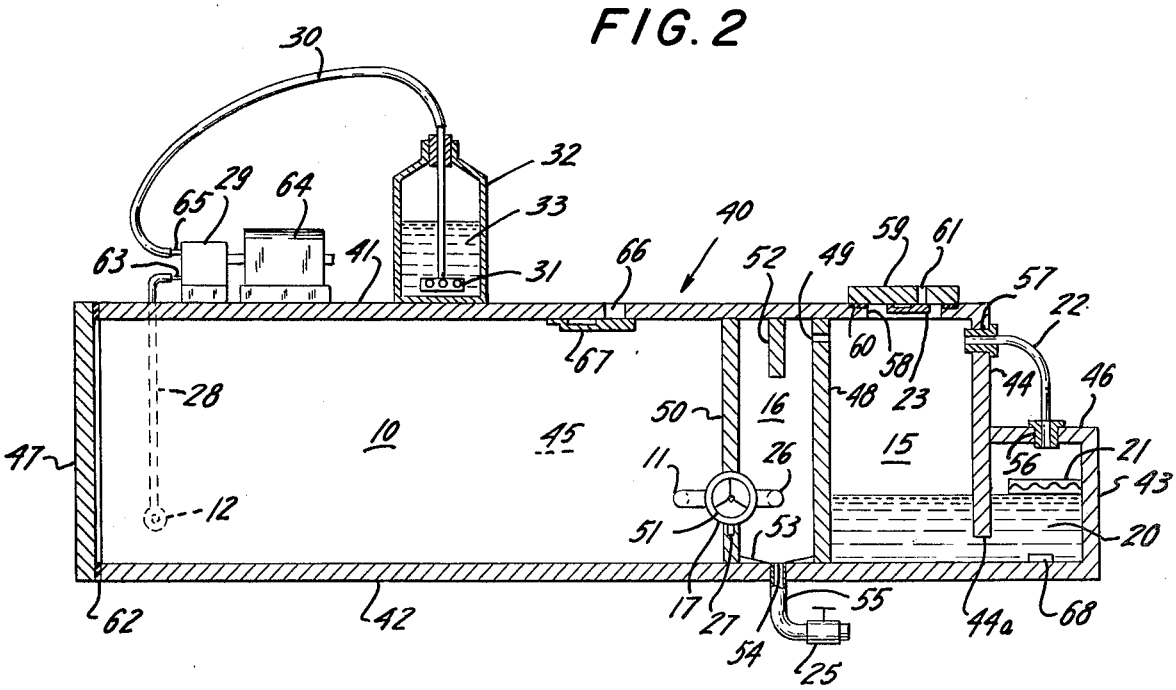
FIG. 2 is a side cross-sectional view of a preferred embodiment of the developing apparatus of the invention.

A preferred embodiment of the developing apparatus of the invention is shown in FIG. 2, wherein it can be seen that the developing chamber 10, the reservoir 15, the heating chamber 20, and the condensation chamber 16 are all contained in a single housing 40, formed as an integral unit with the chambers being bounded at least in part by the walls of the housing. Moreover, the reservoir 15, the condensation chamber 16 and the developing chamber 10 are arranged within the housing in an in-line relationship so that chambers 15 and 16 have a common boundary; and, similarly, chambers 16 and 10 have a second common boundary. The housing 40 is formed by a top wall 41, a bottom wall 42, a first rear end wall 43, a second rear end wall 44, a pair of side walls 45 (only one shown) a top wall 46 enclosing the heating chamber 20 and a cover or door 47, forming a box-like configuration. End wall 44 has a downwardly extending projection 44*a* and bottom 42 permits the free flow of liquid ammonia between the reservoir and the heating chamber. A wall 48 forms the common boundary between the reservoir 15 and the condensation chamber 16. A series of small apertures 49 (only one shown) extend along the upper portion of wall 48 and serve to communicate the reservoir 15 and the condensation chamber 16. A further wall 50 forms the common boundary between the condensation chamber 16 and the developing chamber 10.

Three-way valve 17 (which is not shown in cross-section) is mounted on the side of housing 40 by any suitable means to outlet port 26 of the condensation chamber 16 and inlet port 11 of the developing chamber 10. A valve handle 51 permits manual selection of the desired valve position. A downwardly extending wall or baffle 52 is provided at the uppermost portion of condensation chamber 16 in the direct line of flow from aperture 49 to serve as a collecting surface for ammonia or ammonium hydroxide condensate introduced into the condensation chamber. The lower portion of the condensation chamber 16 is provided with an inclined surface 53 and an outlet port 54. A section of flexible tubing 55 connects outlet port 54 with petcock 25 to permit drainage of the accumulated ammonia condensate. Upper wall 46 of the heating chamber 20 is provided with an opening 56 for the discharge of ammonia vapor, a corresponding opening 57 is provided on the upper part of end wall 44. Flexible tubing 22 connects opening 56 with opening 57 to provide a means for communication of the ammonia vapor from the heating chamber to the upper portion of the reservoir 15.

To provide access to the reservoir 15 to replenish the supply of ammonium hydroxide, the reservoir 15 includes an opening 58 formed in top wall 41 and a removable cover 59 which is preferably hingeably connected to the top of housing 40. A gasket 60 disposed between the cover 59 and the top of housing 40 provides a suitable seal to prevent excessive air from being introduced into the reservoir. An opening 61 is formed in cover 59 which serves as an air inlet port. A check valve 23 comprising a flexible spring like plate fixedly attached to cover 59 encloses opening 61, and as noted hereinabove, is adapted to open upon the reduction of the internal pressure of reservoir 15 below that of the ambient atmospheric pressure to permit the entry therein of ambient air. Door 47 is also swingable attached to the housing 40 to permit access to developing chamber 10 for the purpose of inserting and removing photo-sensitive plates. A gasket 62 is disposed between door 47 and the end of housing 40 to prevent excessive air from being drawn into the developing chamber. The means for hingeably connecting both cover 59 and cover 47 to the respective portions of the housing 40 will be apparent to those skilled in the art.

Outlet 12 of the developing chamber 10 is connected by flexible tubing 28 to the inlet port 63 of vacuum pump 29. The pump 29 is fixedly mounted on the top of housing 40 and is operatively driven by means of an electric motor 64 also disposed on the top of housing 40. Similarly, absorption vessel 32 is disposed adjacent motor 64 and is connected to outlet 65 of pump 29 by means of flexible tubing 30. Check valve 34, which is disposed on the top of housing 40, comprises an opening 66, and a flexible spring like plate 67 fixedly attached to the underside of top wall 41 of the housing 40 to enclose opening 66.

In operation, a rack containing a plurality of exposed sensitized diazo plates is placed into developing chamber 10 via door 47 which is thereupon sealed in place. Heater 21 is then energized and valve 17 moved to its first position to conduct vaprous ammonia into the developing chamber 10. Simultaneously therewith motor 64 is activated to drive vacuum pump 29. Heater 21 then raises the temperature of the ammonium hydroxide solution within heating chamber 20 sufficiently to vaporize the same. The vapors are conducted from heating chamber 20 to reservoir 15 via conduit 22 and are thereupon conducted together with a mixture of air which enters reservoir 15 via check valve 23, through condensation chamber 16 to the developing chamber 10 via valve 17. Vacuum pump 29 maintains the flow of gaseous ammonia across the plates to be developed within chamber 10, and thermostat 69 maintains the desired temperature of such gas. After the developing process, which takes approximately three minutes, valve 17 is moved to its second position wherein it connects developing chamber 10 with the ambient air. Pump 29 causes the flow of such air through chamber 10 to evacuate all of the remaining ammonia fumes. The ammonia removed from the developing chamber 10 is pumped into absorption vessel 32 to dissipate the same.

The foregoing description is intended to be merely illustrative of the developing apparatus of the present invention. Other embodiments and alternative designs within the scope of this invention will be apparent to those skilled in the art.

What is claimed is:

1. An apparatus for developing an image on high resolution photo-sensitive plates comprising, in combination, a developing chamber having an inlet, an outlet, and means for receiving a plurality of sensitized plates to be developed disposed in the line of flow from the inlet to the outlet; means for vaporizing a supply of a developer producing liquid to generate gaseous developing medium; selectively operable valve means for alternately introducing said developing medium into the chamber via the inlet to expose the plates thereto to effectuate image development, and ambient air into said chamber to flush the gaseous developing medium therefrom after development of the plates; and a vacuum pump in communication with the outlet of said chamber to induce the continuous flow of gaseous developing medium or ambient air therethrough.

2. An apparatus in accordance with claim 1, in which a condensation chamber is interposed in the line of flow from the vaporizing means to the developing chamber to remove droplets of liquid developer which may be entrained in the gaseous developing medium.

3. An apparatus in accordance with claim 1, in which the output of the vacuum pump is in communication with an absorption vessel containing suitable material to absorb the discharged gaseous developing medium.

4. An apparatus for developing photo-sensitive plates comprising, in combination, a developing chamber having an inlet and an outlet and adapted to hold a plurality of sensitized plates in the line of flow from the inlet to the outlet; a reservoir for developer producing liquid; heating means adapted to vaporize a quantity of the developer producing liquid within the reservoir to generate gaseous developing medium; means for introducing ambient air into the reservoir to dilute the gaseous developing medium to the desired concentration; a condensation chamber having an inlet in communication with the reservoir and an outlet in communication with the developing chamber adapted to remove any droplets of liquid developer entrained in the gaseous developing medium; a vacuum pump having an inlet in communication with the outlet of the developing chamber to cause the flow of gaseous developing medium therethrough to effectuate development of sensitized plates disposed therein; and means communicating with the output of said vacuum pump to absorb the discharged developing medium.

5. An apparatus in accordance with claim 4, in which the means for introducing ambient air comprises a normally closed valve responsive to the differential in pressure between the exterior atmosphere and internal pressure of the reservoir and adapted to open when said internal pressure is reduced below a predetermined value.

6. An apparatus in accordance with claim 4, in which a three-way valve is interposed between the outlet of the condensation chamber and the inlet of the developing chamber, and adapted to selectively interconnect said condensation chamber to said developing chamber in one position to permit the flow of gaseous developing medium into the developing chamber, and to close the outlet of the condensation chamber and permit the entry of ambient air into the developing chamber in a second position.

7. An apparatus in accordance with claim 4, in which the heater is electrically powered; and thermostatic control means is disposed within the liquid developer, said means being responsive to the temperature of the liquid developer, to maintain the temperature of the heater at a sufficiently high level to continuously vaporize said liquid and to prevent overheating when no liquid is present.

8. An apparatus in accordance with claim 7, in which a second thermostatic control means for the heater is disposed within the reservoir above the liquid, said second means being responsive to the temperature of the gaseous developing medium in said chamber to energize the heater to maintain such temperature within a predetermined range.

9. An apparatus for developing high resolution photo-sensitive diazo plates by exposure to ammonia vapor comprising, in combination, a reservoir for an ammonium hydroxide solution; heating means for vaporizing said ammonium hydroxide to produce humidified ammonia vapor within said reservoir; means for introducing ambient air into said reservoir to mix with the said ammonia vapors; a condensation chamber in communication with said reservoir to receive the ammonia vapor-air mixture and to condense any liquid ammonia droplets therein; a developing chamber having an inlet, and an outlet, and means for holding a plurality of high resolution photo-sensitive diazo plates in the line of flow from the inlet to the outlet; a three-way valve to selectively communicate the condensation chamber and the inlet of the developing chamber to introduce the ammonia vapor-air mixture therein, and the exterior of the apparatus and the developing chamber to introduce ambient air therein for flushing said ammonia from the developing chamber; and a vacuum pump in communication with the outlet of the developing chamber to cause the flow of ammonia through the developing chamber in contact with the photo-sensitive plates during development, and to cause the flow of ambient air therethrough to evacuate the ammonia from the developing chamber during flushing.

10. An apparatus in accordance with claim 9, in which the reservoir, the condensation chamber and developing chamber are disposed as individual compartments within a single housing.

11. An apparatus in accordance with claim 10, in which said housing includes a first common wall separating the reservoir and the condensation chamber, and a second common wall separating the condensation chamber and the developing chamber; said first common wall having a plurality of apertures therein to communicate the chambers separated thereby.

12. An apparatus in accordance with claim 9, in which the output of the vacuum pump is in communication with an absorption vessel containing citric acid to absorb and neutralize the ammonia vapor discharged from the developing chamber.

13. An apparatus in accordance with claim 9, in which the developing chamber includes a pressure sensitive valve in communication with the exterior thereof, adapted to maintain the internal pressure of the developing chamber at a relatively constant level by permitting the entry of ambient air upon the excessive reduction of the internal pressure, to insure uniform development of the sensitized diazo plates and to prevent excessive underpressurization in the event of a malfunction of the three-way valve.

14. An apparatus in accordance with claim 10, in which the housing includes a sealable opening to permit the introduction and removal of the sensitized plates.

* * * * *